US010391544B2

(12) United States Patent
Murphy

(10) Patent No.: US 10,391,544 B2
(45) Date of Patent: Aug. 27, 2019

(54) GAUGE CUTTING SYSTEM AND METHOD

(71) Applicant: Michael J. Murphy, Marion, OH (US)

(72) Inventor: Michael J. Murphy, Marion, OH (US)

( * ) Notice: Subject to any disclaimer, the term of this patent is extended or adjusted under 35 U.S.C. 154(b) by 110 days.

(21) Appl. No.: 15/480,840

(22) Filed: Apr. 6, 2017

(65) Prior Publication Data

US 2017/0291213 A1 Oct. 12, 2017

Related U.S. Application Data

(60) Provisional application No. 62/320,074, filed on Apr. 8, 2016.

(51) Int. Cl.

| | |
|---|---|
| ***B21F 11/00*** | (2006.01) |
| ***B26D 1/30*** | (2006.01) |
| ***B26D 7/28*** | (2006.01) |

(52) U.S. Cl.

CPC ..... *B21F 11/00* (2013.01); *B26D 1/30* (2013.01); *B26D 7/28* (2013.01)

(58) Field of Classification Search

CPC . B21F 11/00; B21F 1/026; B26D 1/30; B26D 7/28; Y10T 225/246; Y10T 225/247; Y10T 83/896; Y10T 83/902

See application file for complete search history.

(56) References Cited

U.S. PATENT DOCUMENTS

| | | | | |
|---|---|---|---|---|
| 729,864 A * | 6/1903 | Hoefer | ..... | B21F 11/00 140/140 |
| 3,077,133 A * | 2/1963 | Hanscom | ..... | B65C 11/02 156/DIG. 49 |
| 2005/0034585 A1* | 2/2005 | Antal | ..... | B26D 1/0006 83/649 |

FOREIGN PATENT DOCUMENTS

| | | | |
|---|---|---|---|
| CN | 203508876 U | * | 4/2014 |
| GB | 561782 A | * | 6/1944 |

* cited by examiner

*Primary Examiner* — Stephen Choi
(74) *Attorney, Agent, or Firm* — Tarolli, Sundheim, Covell & Tummino LLP; John A. Yirga, Esq.

(57) ABSTRACT

A gauge cutting system and method are described herein. The gauge cutting system includes a cutting apparatus coupled to a track for cutting a wire and a movable measurement apparatus spaced from the cutting apparatus and coupled to the track. The measurement apparatus for measuring a length of wire extending from the cutting apparatus by looping said wire around said measurement apparatus and returning a cut end of the wire to the cutting apparatus, wherein a distance of the measurement apparatus from the cutting apparatus is proportional to the length of wire to be cut.

19 Claims, 16 Drawing Sheets

GAUGE CUTTING SYSTEM AND METHOD

CROSS-REFERENCE TO RELATED APPLICATIONS

The present application claims priority under 35 U.S.C. § 119(e) to U.S. Provisional Patent Application Ser. No. 62/320,074 filed Apr. 8, 2016 entitled GAUGE CUTTING SYSTEM AND METHOD, the entire contents of the above-identified application from which priority is claim is incorporated herein by reference in its entirety for all purposes.

FIELD OF THIS DISCLOSURE

The present disclosure relates to a gauge cutting system and method of formation thereof. More specifically, the present disclosure relates to a gauge cutting system having a repeatable and precise wire measurement and cutting ability.

BACKGROUND

Historically, cables, such as braided wires and the like, used for garage door repair, which require cutting to size, are cut onsite. However, cutting wires and cables with consistent accuracy and precision is difficult, as there is no portable means to measure and cut the wire. Measuring the wire, which needs to be pulled taught for accuracy, is difficult, as the desired wire length typically far exceeds a man's arm length. Wire will typically remain slightly arced, as it is stored on a spool or a like structure. Further, correctly measuring and then cutting the wire is time consuming, traditionally requires more than one person, and may result in wire cut to an incorrect length.

SUMMARY

One aspect of the present disclosure comprises gauge cutting system comprising a wire dispensing apparatus that dispenses wire coupled to a cutting apparatus. The cutting apparatus comprising an attachment structure, a wire end securing structure coupled to the attachment structure for securing a first end of the wire once the wire has been looped around a measurement apparatus when in use, and a blade, coupled to the attachment structure opposite the wire dispensing apparatus, for cutting wire. The gauge cutting system further comprises a track slidably coupled to the measurement apparatus, and coupled to the cutting apparatus opposite the wire dispensing apparatus, comprising a slot that extends a partial length of the track, the track comprising tick marks denoting a measurement unit. The measurement apparatus is slidably coupled to the track via the slot. The measurement apparatus comprises a hub and an indicator. The indicator when aligned with a tick mark of a specific measurement indicates a length of the wire to be cut. The hub is for looping the wire around before returning and securing the wire to the wire end securing structure.

Another aspect of the present disclosure comprises a method of providing a gauge cutting system comprising providing a wire dispensing apparatus that dispenses wire and providing a cutting apparatus to be coupled to the wire dispensing apparatus. The cutting apparatus comprises an attachment structure comprising a through opening for the wire to pass through, a wire end securing structure coupled to the attachment structure for securing a first end of the wire once the wire has been looped around a measurement apparatus when in use, and a blade, coupled to the attachment structure opposite the wire dispensing apparatus, for cutting wire. The method further comprises providing a track, to be coupled to the cutting apparatus opposite the wire dispensing apparatus. The track comprises a slot that extends at least a partial length of the track, the track comprises tick marks denoting a measurement unit. The method additionally comprising providing the measurement apparatus that is slidably couplable to the track via the slot, the measurement apparatus comprising a hub and an indicator. The indicator when aligned with a tick mark of a specific measurement indicates a length of the wire to be cut. The hub is for securing the wire around before returning and securing the wire to the wire end securing structure.

Yet another aspect of the present disclosure comprises a gauge cutting system comprising a wire dispensing apparatus that dispenses wire coupled to a cutting apparatus. The cutting apparatus comprising an attachment structure comprising a through opening for the wire to pass through, a wire end securing structure coupled to the attachment structure for securing a first end of the wire once the wire has been looped around a measurement apparatus when in use, and a blade located in a notch of a cutting device, the cutting device coupled to the attachment structure opposite the wire dispensing apparatus, the blade for cutting wire. The gauge cutting system further comprises a track, coupled to the cutting apparatus opposite the wire dispensing apparatus. The track comprises a slot that extends at least a partial length of the track and comprises tick marks denoting a measurement unit. The measurement apparatus comprises a sliding device that is slidably coupled to the track via the slot. The measurement apparatus comprises a hub and an indicator coupled to the sliding device. The indicator, when aligned with a tick mark of a specific measurement, indicates a length of the wire to be cut once the wire is looped around the hub and returned and secured to the wire end securing structure.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

Figure 1:
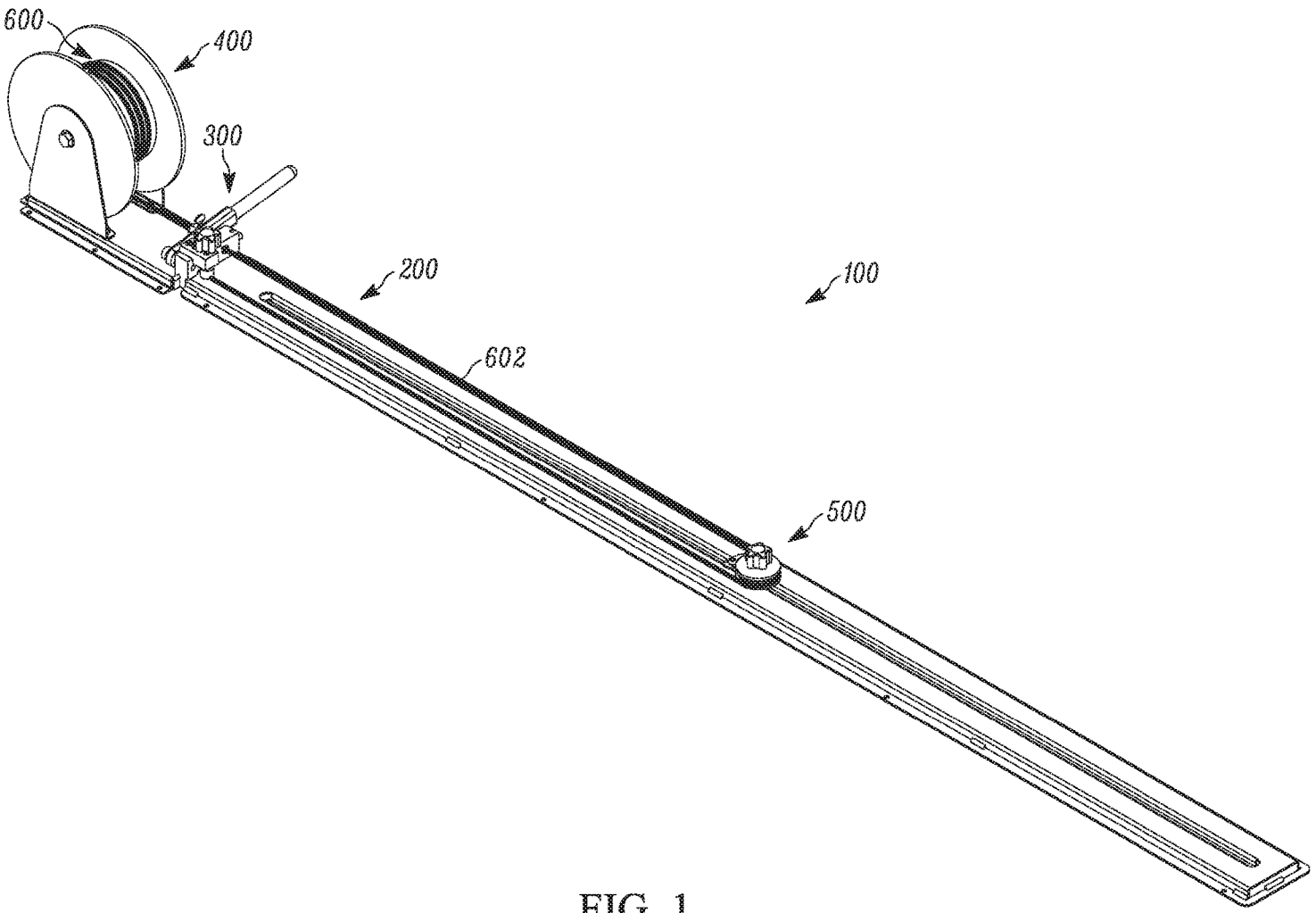
FIG. 1 is perspective view of a gauge cutting system in accordance with one example embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to a gauge cutting system and method. More specifically, the present disclosure relates to a gauge cutting system having a repeatable and precise wire measurement and cutting ability.

As shown in FIG. 1, a gauge cutting system 100 is illustrated. The gauge cutting system comprises a track 200, a cutting apparatus 300, a dispensing apparatus 400, and a measurement apparatus 500. The dispensing apparatus 400 supports a spool of wire 600, or other means of dispensing wire. While wire is referred to herein generally, it should be appreciated that the "wire" includes braded wire, cable, single gauge wire, rope, plastic, and the like. The measurement apparatus 500 is slidably coupled to the track 200, and is moved along said track until the measurement apparatus is aligned with a desired length (e.g., as denoted by tick marks 203 indicating a length corresponding to the desired length of wire, discussed further below, the tick marked being marked or embossed on the track, see FIG. 2). Once positioned at a location corresponding to the desired length, the measurement apparatus 500 is frictionally secured in place (e.g., the measurement apparatus is inhibited from sliding along the track 200). Spooled wire 600 is unspooled from the dispensing apparatus 400 and passes through a portion of the cutting apparatus 300, the wire is then wound around a hub 502 (see e.g., FIG. 13) of the measurement apparatus 500. The wire 600 is secured to a portion the cutting apparatus 300, and then cut. A fabricated wire 602 (e.g., a section of wire to be cut) is then separated from the spooled wire 600 at the desired length.

As illustrated in FIGS. 2-5, the track 200 comprises a base component 220 and a cover component 218, wherein the base component is coupled to the cover component. In one example embodiment, the base component 220 is detachable from the cover component 218. The track 200 comprises a front side 208, a rear side 210, a left side 212, and a right side 214. The terms "front side", "rear side", "right side", and "left side" are used only to provide clarity to the description of the gauge cutting system 100 and do not in any way add limitations to the gauge cutting system. The track 200 comprises one of plastic, metal, or a combination thereof. The track has a track length 219 between about 5' to 9' (feet). The cover component 218 comprises sidewalls 218*a*, 218*b*, 218*c*, and 218*d* that extend one of transversely or perpendicularly from a top surface 224 of the cover component. In one example embodiment, the cover component 218 is coupled to the base component 220 via the sidewalls 218*a*, 218*b*, 218*c*, and 218*d*. In another example embodiment, an internal track area is defined by a bottom surface 217 of the cover component 218, the sidewalls 218*a*, 218*b*, 218*c*, and 218*d*, an a top surface (not shown) of the base component 220. It would be understood by a person having ordinary skill in the art that a unibody track or other configurations to form the track 200 are contemplated.

In one example embodiment, the track 200 comprises a central slot 202 formed in the cover component 218 having a first end 204 and a second end 206. The slot 202 runs parallel to the track 200 in a longitudinal direction, forming a longitudinal axis "LA." As in the illustrated example embodiment of FIG. 4, the slot 202 comprises first and second protrusions 228*a*, 228*b* that extend a first length 213 from the cover component 218 towards the base component 220 when assembled, and further extend from the first end 204 to the second end 206 along edges of the slot. The first and second protrusions 228*a*, 228*b* comprise a first and second protrusion bearing surfaces 230*a*, 230*b* facing the top surface of the base component 220. The first and second protrusion bearing surfaces 230*a*, 230*b* are one of transverse or parallel to the top surface 224. The first and second protrusions 228*a*, 228*b* further comprise first and second protrusion lateral bearing surfaces 232*a*, 232*b*. The first and second protrusion lateral bearing surfaces 232*a*, 232*b* face each other across the slot 202 and extend along the length of the first and second protrusions 228*a*, 228*b* one of transversely or parallel to the sidewalls 218*a*, 218*b*. In one example embodiment, the first and second protrusions 228*a*, 228*b* have an interior separation width 211*a*, comprising a distance between the first and second protrusion lateral bearing surfaces 232*a*, 232*b*, respectively. In this example embodiment, the first and second protrusions 228*a*, 228*b* have an exterior separation width 211*b*, comprising a distance between first and second outer protrusion surfaces 324*a*, 234*b*, respectively.

In one example embodiment, the sidewalls 218*a*, 218*b*, 218*c*, and 218*d* comprise a second length measured from the top surface 224 to the end of the sidewalls, the second length being greater than the first length 213. In another example embodiment, the top surface 224 comprises the tick marks 203 used to measure and set a desired wire 602 length to be cut and separated from the spooled wire 600. In yet another example embodiment, the base component 220 compresses one or more track openings 220*a*. In one example embodiment, a fastener is inserted into the one or more track openings 220*a* to secure the track 200 to an underlying surface, such as a truck bed, or the like. In another example embodiment, the track 200 comprises one or more attachment members 216 at the rear side 210. In the illustrated embodiment of FIGS. 2-4, the attachment members 216 are threaded screws, however other attachment means are contemplated (e.g., welding, etc.). As shown in the illustrated example embodiment of FIG. 5, the attachment members 216 couple the track 200 to the dispensing apparatus 400 via the cutting apparatus 300.

As in the illustrated example embodiments of FIGS. 5-9, the cutting apparatus 300 comprises a cutting device 302, an attachment structure 316, and a wire end securing structure 307. The cutting apparatus 300 comprises a front side 303, that when attached to the track 200, faces the same direction as the front side 208 of the track, and a rear side 305, that when attached to the track, faces the same direction as the rear side 210 of the track.

In one example embodiment, the cutting device 302 comprises a blade portion 302*b* and a handle portion 302*a*. The blade portion 302*b* and the handle portion 302*a* comprise a same or different material. The blade portion 302*b* and the handle portion 302*a* comprise one of metal, plastic, or some combination thereof. In another example embodiment, the handle portion 302*a* and the blade portion 302*b* are two detachable components. In yet another example embodiment, the handle portion 302*a* and the blade portion 302*b* are a single component.

The blade portion 302*b* comprises a notch 324, wherein a blade, for cutting and separating the spooled wire 600 from the wire 602, is exposed. The blade comprises at least one of stainless steel, hardened steel, or some other material appropriate for cutting wire. The blade portion 302*b* is coupled to the attachment structure 316. In one example embodiment, the blade portion 302 is hingedly connected to the attachment structure 316 via a hinge screw 306*a* inserted through a hinge opening 306*b* of the blade portion and coupled to the attachment portion 316. In another example embodiment, the cutting device 302 interacts with a spring 326 that provides resistance when pressing down on the cutting device. The spring 326 is coupled to at least one of the attachment portion 316, or an upper face 408*a* of a support member 408 of the dispensing apparatus 400 (see FIG. 5).

In one example embodiment, the attachment portion 316 comprises an upper area 328*a* and a lower area 328*b*. The attachment portion 316 comprises one of metal, plastic, or a combination thereof. In another example embodiment, the upper area 328*a* has a greater longitudinal axis LA width than the lower portion 328*b*. In this example embodiment, the upper area 328*a* has two lower facing surfaces 327 that interact with the upper surface 224 of the track 200 and the upper surface 408*a* of the support member 408 of the dispensing apparatus 400 (see FIG. 5). The upper area 328*a* comprises a first through opening 320 and a second opening 325. In one example embodiment, the spooled wire 600 goes through the notch 324 (e.g., becoming the wire 602 to be cut) and the first through opening 320 toward the track 200, and after interacting with the measuring apparatus 500, enters, but does not go through the second opening 325. In this example embodiment, the first opening 320 is co-axial with the notch 324. In another example embodiment, the upper area 328*a* comprises an indent in a top surface where the wire securing structure 307 is coupled to the attachment portion 316.

In one example embodiment, the wire securing structure 307 comprises a connecting structure 310 and a securing member 308. The connecting structure 310 and the securing member 308 comprise one of metal, plastic, or a combination thereof. The connecting structure 310 and the securing member 308 comprise a same or a different material. In one example embodiment, the connecting structure 310 is attached to the attachment portion 316 via one or more attachment components 309 (e.g., such as fasteners or screws), wherein the attachment portion 316 and the connecting structure 310 comprises corresponding opening 311 (e.g., such as threaded or tapped openings). In another example embodiment, the connecting structure 310 and the attachment portion 316 are formed as a single structure.

In one example embodiment, the connecting structure 310 comprises a connecting opening 310*a*. The connecting opening 310*a* is at least one of threaded or unthreaded. The securing member 308 comprises a head portion 318*a* coupled to a middle portion 318*c*, wherein the middle portion couples to a base portion 318*b*. In the illustrated example embodiment, the middle portion 318*c* of the securing member 308 comprises a thread size that is complementary to the tapped thread size in the connecting opening 310*a*. In this example embodiment, the middle portion 318*c* is threaded through the connecting opening 310*a* and attached to the base portion 318*b*. Responsive to turning the head portion 318*a*, which in turn turns the connecting portion 318*c*, in a first direction, the base portion 318*b* is lowered to interact with the wire 602 and the top portion 224 of the track 200, wherein the wire is partially in the second opening 325. Stated another way, the base portion 318*b* frictionally bounds the wire 602 in place. Further in this example embodiment, responsive to turning the head portion 318*a* in a second direction opposite the first direction, the base portion 318*b* is raised to stop interacting with the wire 602 and the top portion 224 of the track 200. It would be appreciated by one having ordinary skill in the art that other means of securing the wire 602, such as a locking mechanism calibrated to lock at a frictional locking distance from the top portion 224 of the track 200, or the like, are contemplated.

In one example embodiment, the lower area 328B of the attachment portion 316 comprises one or more attachment member openings 322. In one example embodiment, the one or more attachment members 216 of the track 200 go through the one or more attachment member openings 322 to couple the track 200 to the cutting apparatus 300. In another example embodiment, the one or more attachment member openings 322 comprise complementary threading to the one or more attachment members 216, such that the one or more attachment members threadedly attach the track 200 to the cutting apparatus 300. In another example embodiment, the one or more attachment members 216 of the track 200 go through the one or more attachment member openings 322 and attach to one or more attachment member openings 414 formed in the support member 408 of the dispensing apparatus 400, to couple the track together with the cutting apparatus 300 and the dispensing apparatus. In yet another embodiment, at least one of the track 200, the cutting apparatus 300, and the dispensing apparatus 400 are formed as a single body.

As shown the illustrated example embodiments of FIGS. 9-12, the dispensing apparatus 400 comprises the support member 408, arms 402, a wire securing structure 410, and a dispensing component 412. In one example embodiment, the support member 408 comprises a front side 422, a rear side 424, a left side 426, and a right side 428. The dispensing apparatus 400 comprises one of plastic, metal, or some combination thereof. The support member 408 comprises sidewalls 430*a*, 430*b*, 430*c*, and 430*d* that extend one of transversely or perpendicularly from the top surface 408*a* of the support member. In one example embodiment, the sidewalls 430*a*, 430*b*, 430*c*, and 430*d* are substantially the same (e.g., extend the same distance away from the top surface 408*a*, at the same angle, etc.) as the sidewalls 218*a*, 218*b*, 218*c*, and 218*d*.

In one example embodiment, the sidewalls 430*a*, 430*b*, 430*c*, and 430*d* are coupled to one or more lip portions 432*a*, 432*b*, and 432*d*, respectively. In another embodiment, the lip portion is absent on the front side 422 of the support member 408. In yet another example embodiment, fasteners are inserted into one or more lip openings 416 to secure the support member 408 to an underlying surface, such as a truck bed, or the like. In one example embodiment, the upper surface 224 of the track 200 and the upper surface 408*a* of the support member 408 are coplanar when the gauge cutting device 100 is assembled. In another example embodiment, responsive to the track 200 and the support member 408 being fastened to a co-planer/even surface, the upper surface 224 and the upper surface 408*a* will be coplanar.

In one example embodiment, the arms 402 are coupled to the support member 408. In another example embodiment, the arms 402 are coupled to the support member 408 via bolts, screws, welding, or the like. The arms 402 comprise one of metal, plastic, or some combination thereof. In the illustrated example embodiment, the arms 402 support the dispensing component 412. The dispensing component 412 comprises a spool, or a like structure that stores and dispenses wire 600. In the illustrated example embodiment, the dispensing component 412 is supported by an axle 420 that is centrally located relative to a center point of the substantially circular dispensing component 412. In this example embodiment, the dispensing component 412 comprises a central portion 404 that is sandwiched between two sidewalls 406*a*, 406*b*. It would be appreciated by one having ordinary skill in the art that a multitude of wire dispensing structures were contemplated.

In one example embodiment, the wire securing structure 410 is coupled to the support member 408. In another example embodiment, the wire securing structure 410 comprises a body 410*c* having a wire opening 410*b* that transverses the body from a front face 434*a* to a rear face 434*b*. In yet another example embodiment, the wire opening 410*b* is co-axial with at least one of the notch 324 and the first opening 320. The body 410*c* comprises a thumb opening 410*d*. In one example embodiment, the thumb opening 410*d* is formed through at least one of a first sidewall 434*c*, a second sidewall 434*d*, and a top wall 434*e* and intersects the wire opening 410*b* (see FIG. 12). A frictional tightening structure 410*a* is in the thumb opening 410*d*. In one example embodiment, the frictional tightening structure 410*a* comprises a thumb screw and the thumb opening 410*a* comprises complementary threading to the thumb screw. In another example embodiment, the wire 600 runs from the dispensing component 412 through the wire opening 410*b*, where responsive to the wire being at a desired length, the frictional tightening structure 410*a* is actuated to frictionally retain the wire within the wire opening prior to cutting the wire. In the illustrated example embodiment, the frictional tightening structure 410*a* is rotated until the wire 600 is pressed against a sidewall of the wire opening 410*b* with sufficient force to maintain the position of the wire in the wire opening.

As shown the illustrated example embodiments of FIGS. 13-19, the measuring apparatus 500 comprises a sliding device 508, a positioning device 504, and the hub 502. In one example embodiment, the sliding device 508 comprises one of plastic, metal, or some combination thereof. In one example embodiment, the sliding device 508 comprises an elongated T shape having a body portion 505*a* and a cross portion 505*b*. In another example embodiment, the sliding device 508 comprises a front face 508*a*, a rear face 508*d*, first and second sliding lateral bearing surfaces 509*a*, 509*b*, first and second sliding bearing surfaces 508*b*, 508*c*, a bottom face 527, and a top face 526. When in use, the sliding device 508 is slidably coupled to the slot 200, such that the first and second sliding bearing surfaces 508*b*, 508*c* interact with the first and second protrusion bearing surfaces 230*a*, 230*b* to prevent the sliding device from exiting the slot. The bottom face 527 rests on the top surface of the base component 220 (see FIGS. 3 and 4). The cross portion 505*b* comprises a cross width 511*b* that is greater than at least one of the interior and exterior separation width 211*a*, 211*b*, respectfully, of the first and second protrusions 228, 228*b* (see FIGS. 4 and 16). Thus, retaining the sliding device 508 in the slot 202. When in use, the first and second sliding lateral bearing surfaces 509*a*, 509*b* interact with the first and second lateral protrusion bearing surfaces 232*a*, 232*b* to guide the sliding device 508 from the first end 204 to second end 206 of the slot 202. In this example embodiment, the body portion 505*a* comprises a body width 511*a* that is less than the interior separation width 211*a* of the first and second protrusions 228, 228*b*. In one example embodiment, the difference between the body width 511*a* and the interior separation width 211*a* is between about 0.01 cm to about 1.00 cm (e.g., to prevent debris from entering the slot 202, to increase stability of the sliding device 508 while sliding, etc.). In another example embodiment, a lubricant is applied to facilitate sliding of the sliding component 508, or the sliding component comprises a low friction material. In yet another embodiment, the bottom face 527 comprises wheels and/or the top surface of the base component 220 comprises wheels.

The body portion 505*a* has a body height 511*c* that is greater than the first length 213 of the first and second protrusions 228, 228*b*, such that when in use, the top face 526 and at least some of the first and second sliding lateral bearing surfaces 509*a*, 509*b* protrude above the top surface 224 of the track 200. In one example embodiment, the top surface 526 of the sliding device 508 comprises an indicator opening 520 and a hub opening 518 separated by a first raised area 526*a*. In another example embodiment, the indicator opening 520 is separated from the front face 508*a* by a second raised area 526*b*. In another example embodiment, the hub 502 is coupled to the sliding device 508 via the hub opening 518, and an indicating device 506 is coupled to the sliding device via the indicator opening 518. In yet another example embodiment, the hub opening 518 is a hub distance from the first raised area 526*a*, wherein the hub distance is equal or greater to a radius of the hub 502.

In one example embodiment, the indicator device 506 is coupled to the sliding device 508 via an indicator coupler 501 and the indicator opening 520 between the first and second raised areas 526*a*, 526*b*. The indicator device 506 is coupled to the sliding device 508 such that an indicator portion 506*a* points toward the tick marks 203 on the track 200. The indicator opening 520 is at least one of threaded or unthreaded. The indicator coupler 501 comprises a head portion 501*a* coupled to a shaft portion 501*b*. In the illustrated example embodiment, the shaft portion 501*b* of the positioning coupler 501 comprises threading that is complementary to threading in the indicator opening 520.

Figure 18:
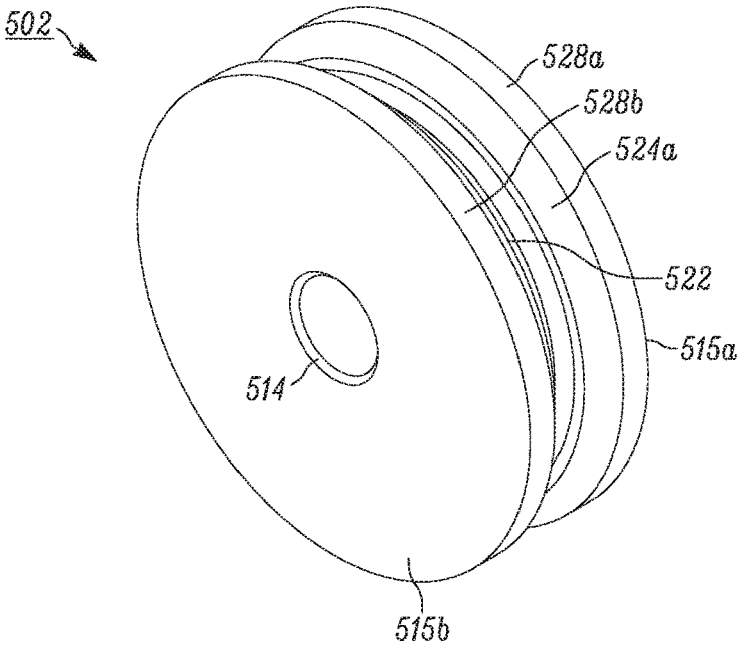
FIG. 18 is a perspective view of a hub of the measurement apparatus of FIG. 13.
Figure 19:
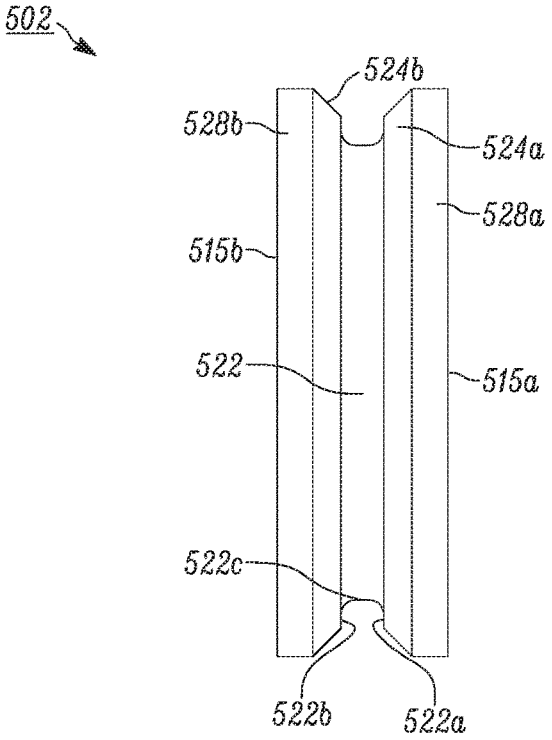
FIG. 19 is a front elevation view of FIG. 18.

As shown in the example embodiments of FIGS. 18-19, the hub 502 comprises a circular wheel having a guiding groove 522 around the perimeter of the hub. In one example embodiment, the guiding groove 522 comprises a central trough 522*c* sandwiched between two sidewalls 522*a*, 522*b*, respectively. In another example embodiment, the height difference between a most depressed point in the trough 522*c* to a top of the sidewalls 522*a*, 522*b* is greater than a diameter of the wire 600 to be cut. In yet another example embodiment, sloping connections 524*a*, 524*b*, connects the sidewalls 522*a*, 522*b* to exterior sidewalls 528*a*, 528*b*, respectively. The exterior sidewalls 528*a*, 528*b* are at least one of transverse or perpendicular to substantially planer top and bottom surfaces 515*a*, 515*b* of the hub 502. In this example embodiment, the sloping connections 524*a*, 524*b* help to direct the wire 600 into the trough 522 during use.

Figure 14:
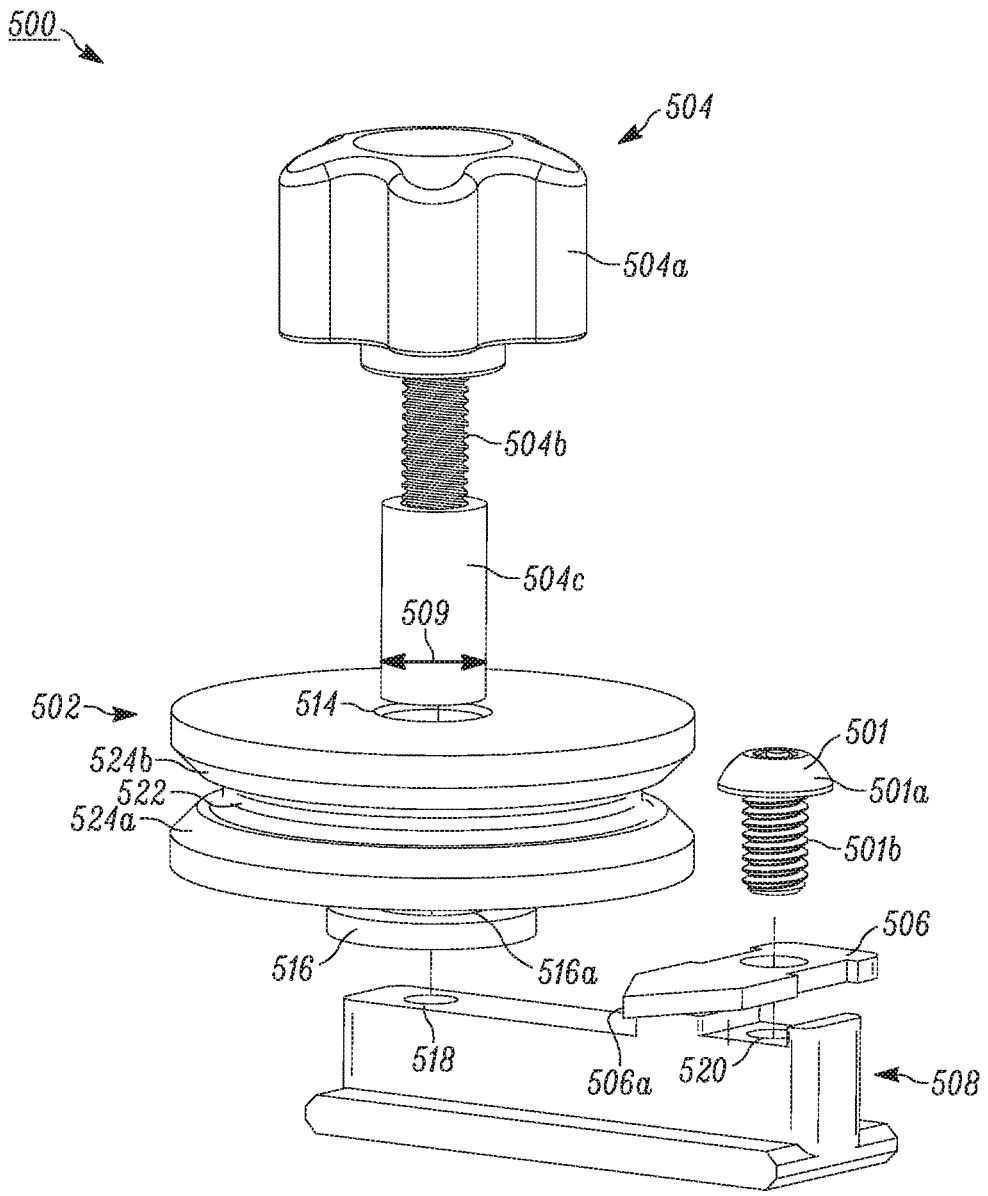
FIG. 14 is an exploded perspective view of FIG. 13.
Figure 15:
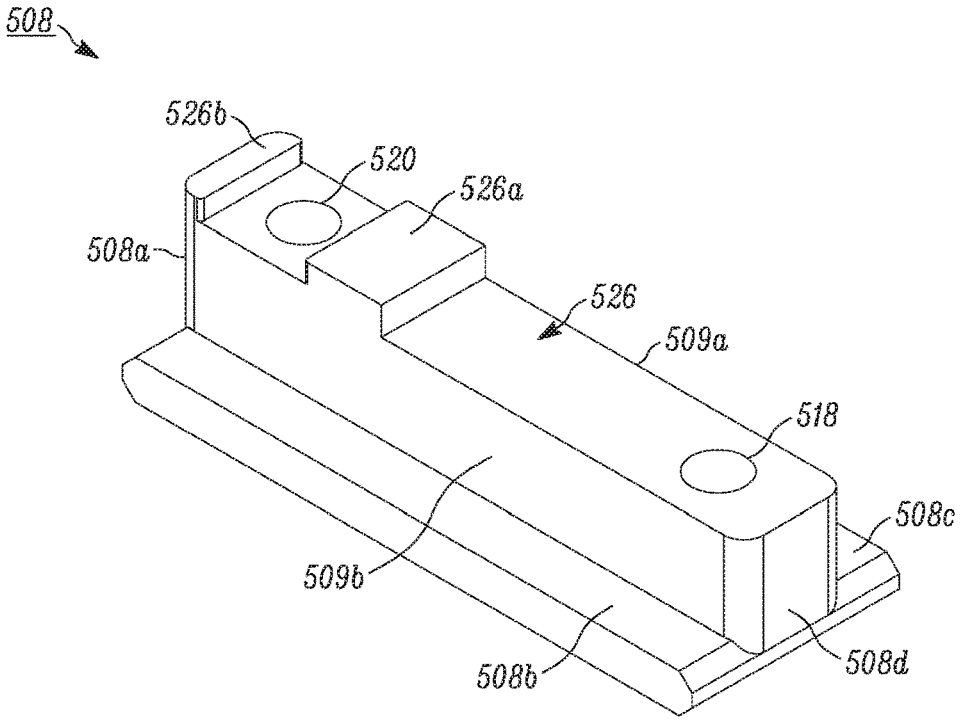
FIG. 15 is a right side perspective view of slide tool of the measurement apparatus of FIG. 13.
Figure 16:
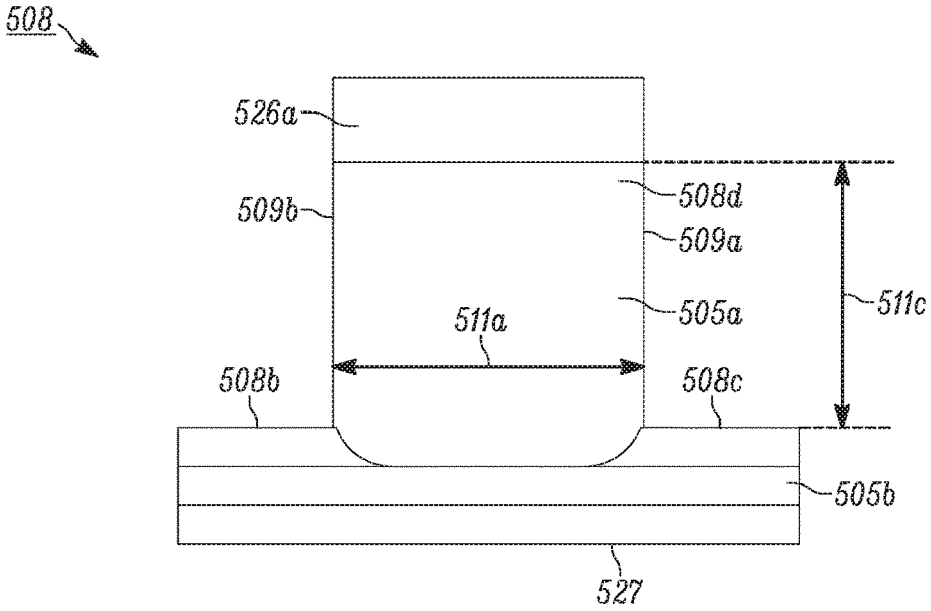
FIG. 16 is front elevation view of FIG. 15.
Figure 17:
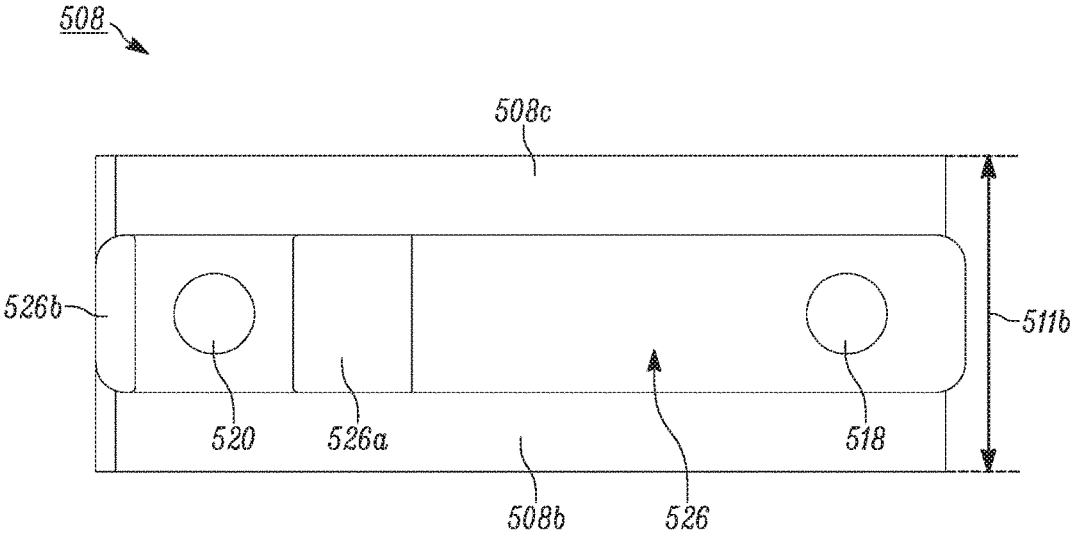
FIG. 17 is a top plan view of FIG. 15.

As shown in the example embodiment of FIG. 14, the hub 502 is secured to the sliding device 508 via the hub opening 518 by an attachment member 504. The hub opening 518 extends from the top surface 526 of the sliding device 508 to the bottom surface 527 of the sliding device. The hub opening 518 is at least one of threaded or unthreaded. The attachment member 504 comprises a head portion 504*a* coupled to a middle portion 504*b*, wherein the middle portion couples to a cover portion 504*c*. In the illustrated example embodiment, the middle portion 504*b* of the attachment member 504 comprises threading that is complementary to threading in the hub opening 518 and/or threading in the cover portion 504*c*. In one example embodiment, the middle portion 504*b* is threaded through the cover portion 504*c* and a washer portion 516 and attached to the sliding device 508. In this example embodiment, a central diameter 516*a* of the washer portion 516 is less than an outer diameter 509 of the cover portion 504*c*, such that regardless of a position of the head portion 504*a*, the cover portion remains located inside an attachment opening 514 of the hub 502 when the sliding device 500 is assembled. Thus, allowing the hub 502 to rotate 360° about the cover portion 504*c*.

Figure 2:
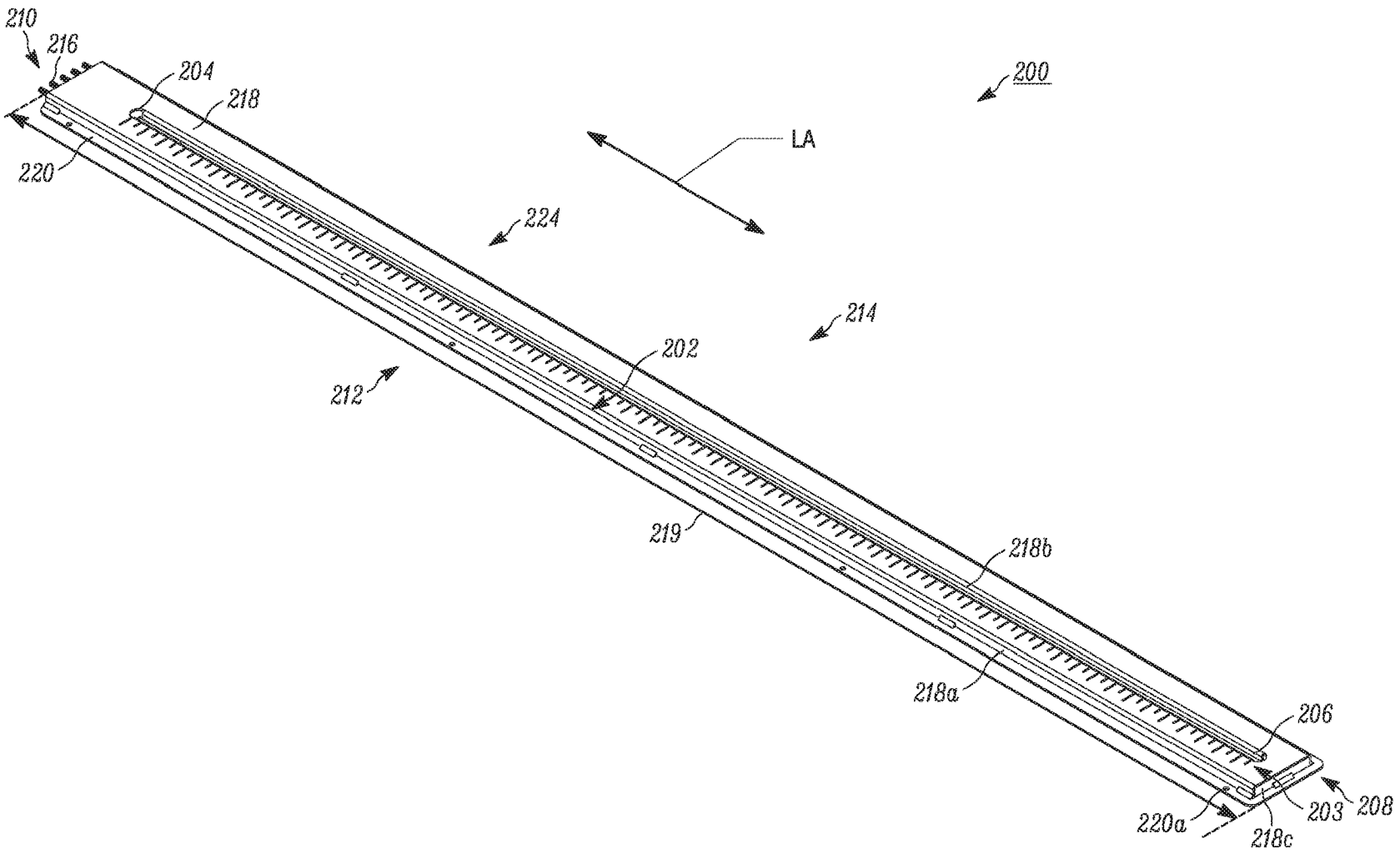
FIG. 2 is a top perspective view of a track of the gauge cutting system of FIG. 1.
Figure 3:
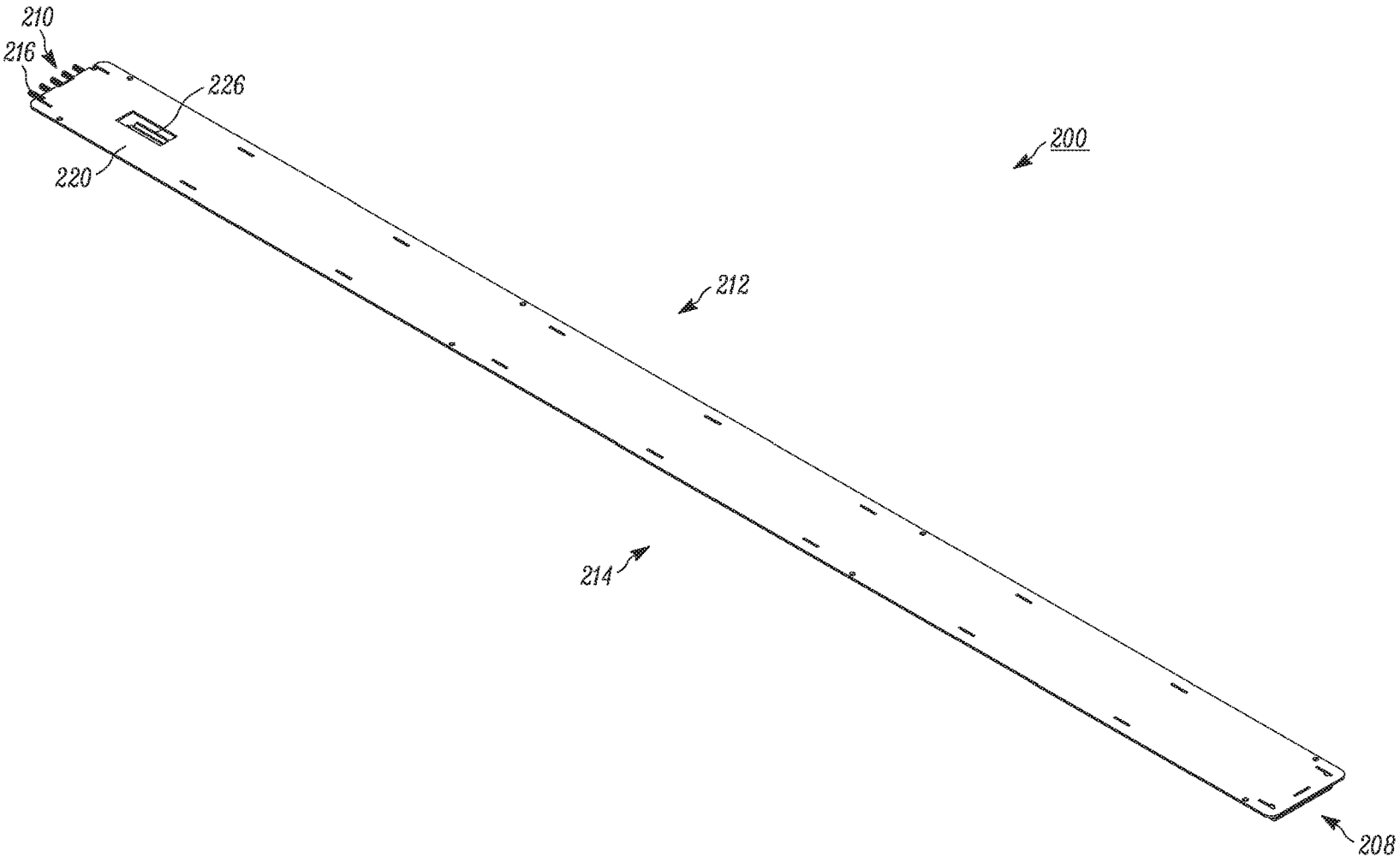
FIG. 3 is a bottom perspective view of FIG. 2.
Figure 4:
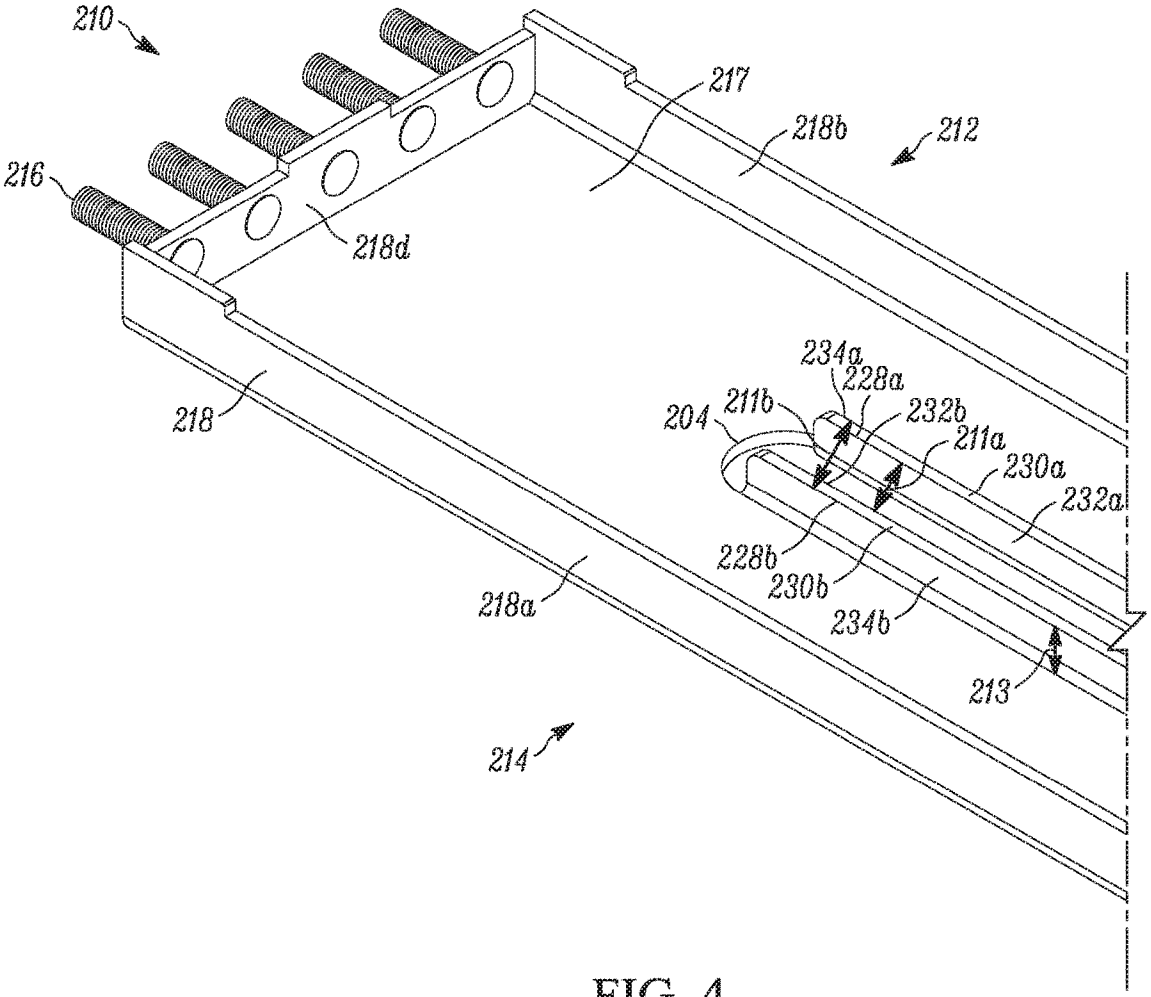
FIG. 4 is a magnified view of a first end of the track of FIG. 2 wherein a base component is omitted.
Figure 5:
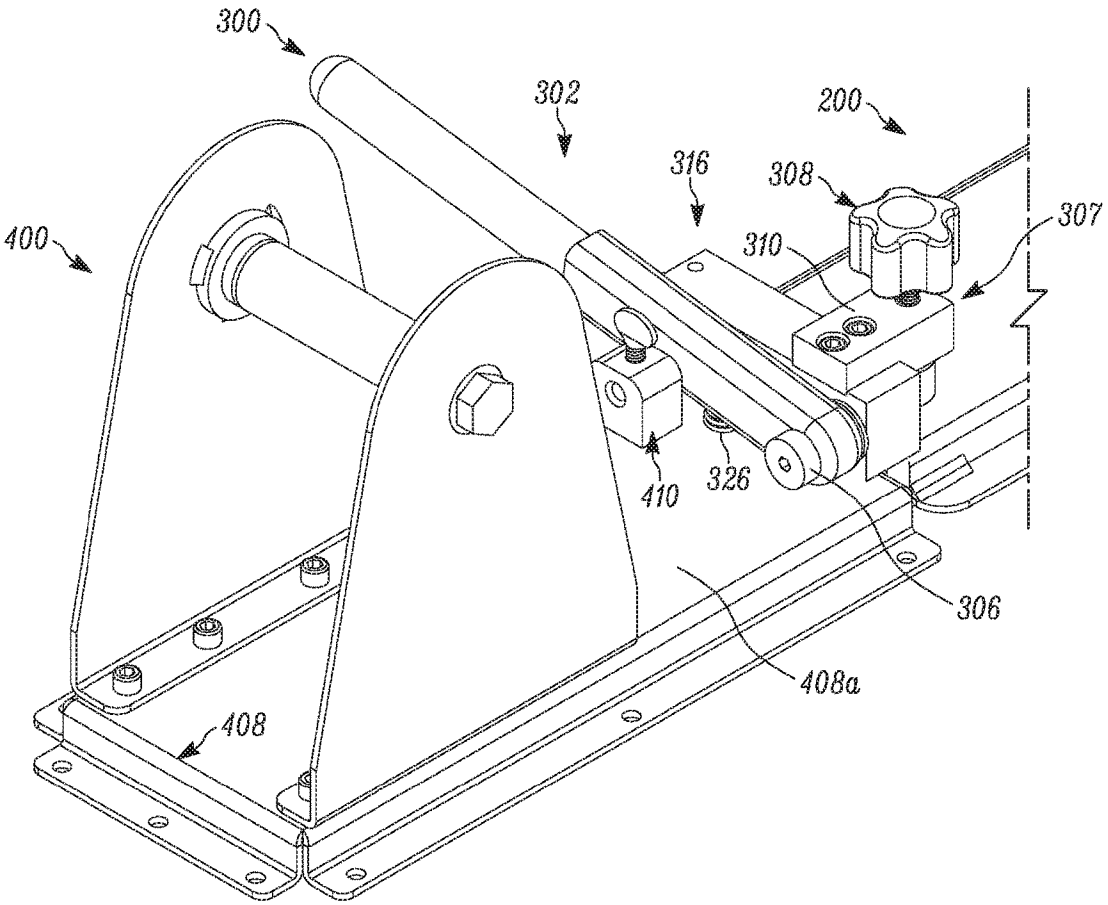
FIG. 5 is a perspective view of a cutting apparatus and dispensing apparatus of the gauge cutting system of FIG. 1.
Figure 6:
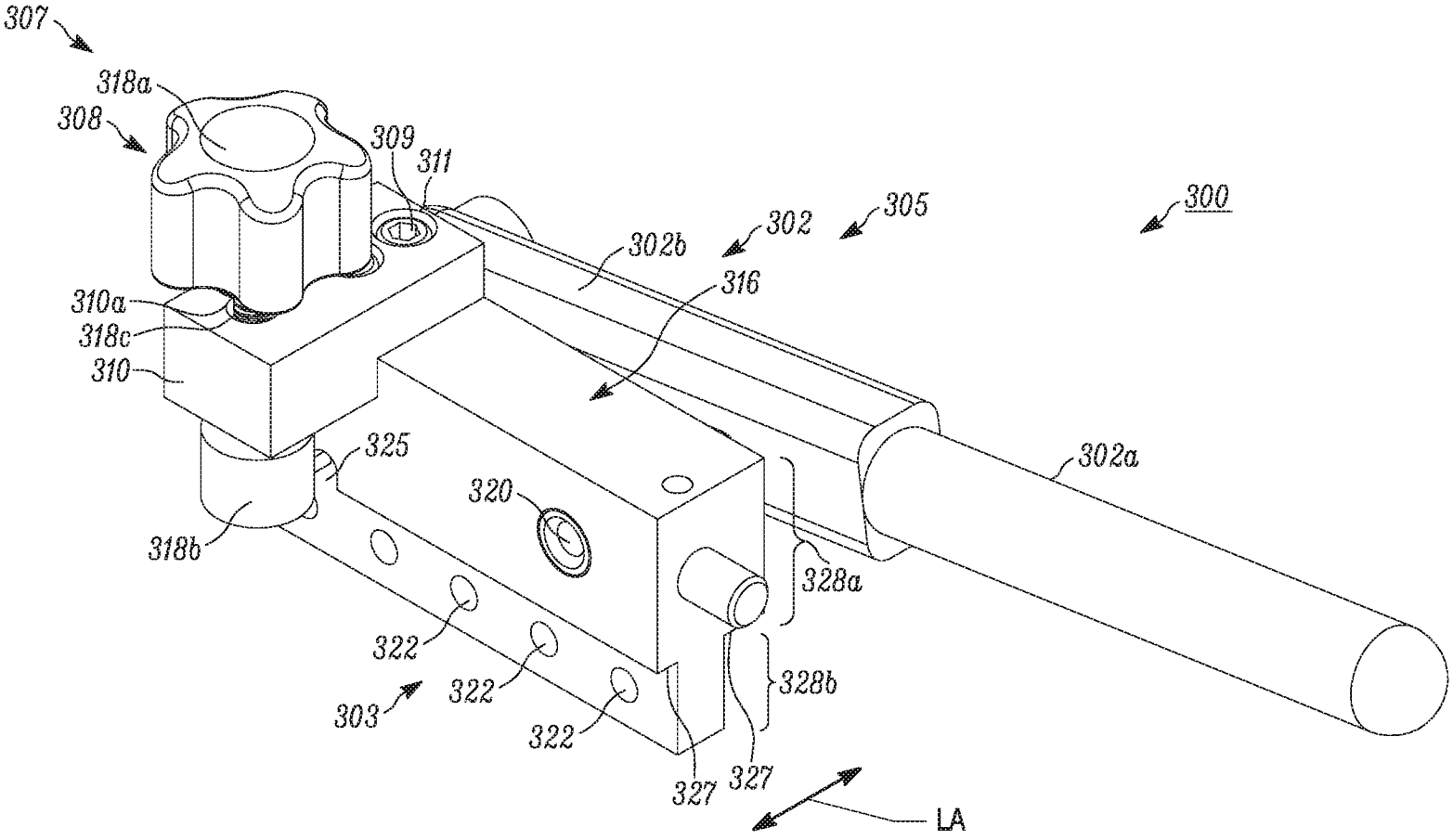
FIG. 6 is a front side perspective view of a cutting apparatus of the gauge cutting system of FIG. 1.
Figure 7:
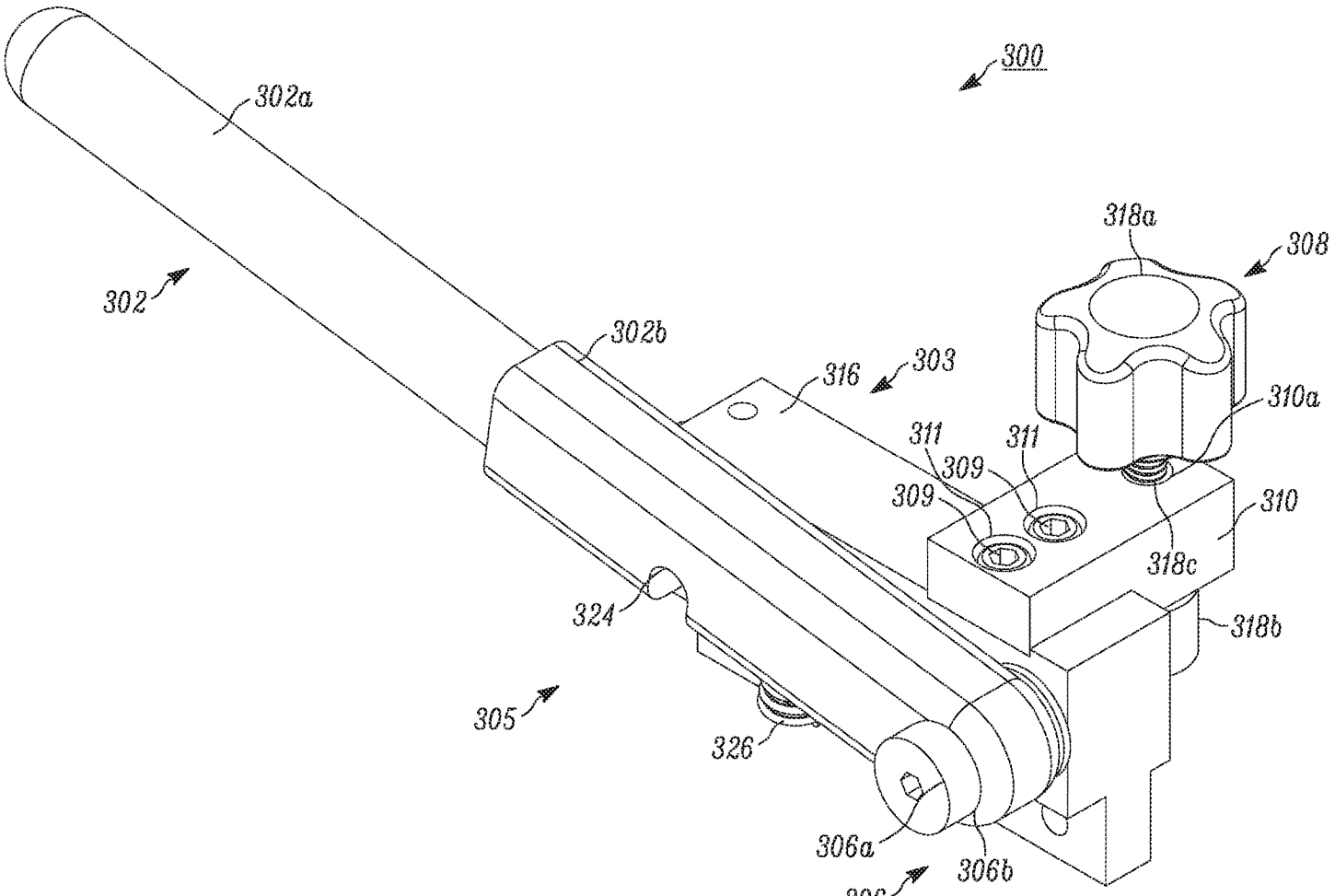
FIG. 7 is a rear side perspective view of FIG. 6.
Figure 8:
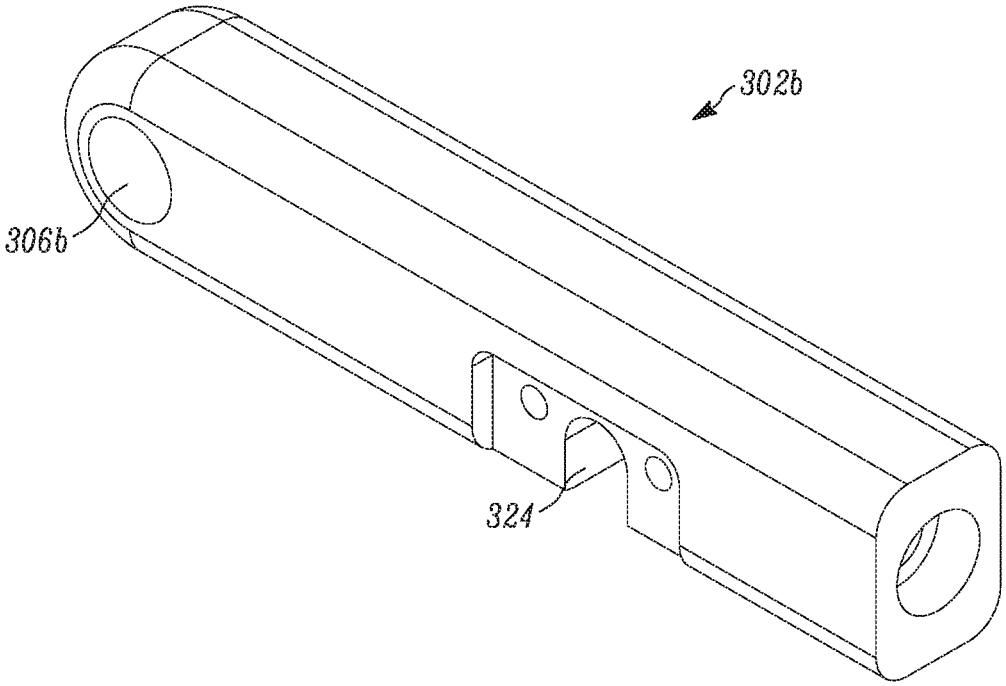
FIG. 8 is a front side perspective view of a portion of a handle of the cutting apparatus of FIG. 6.
Figure 9:
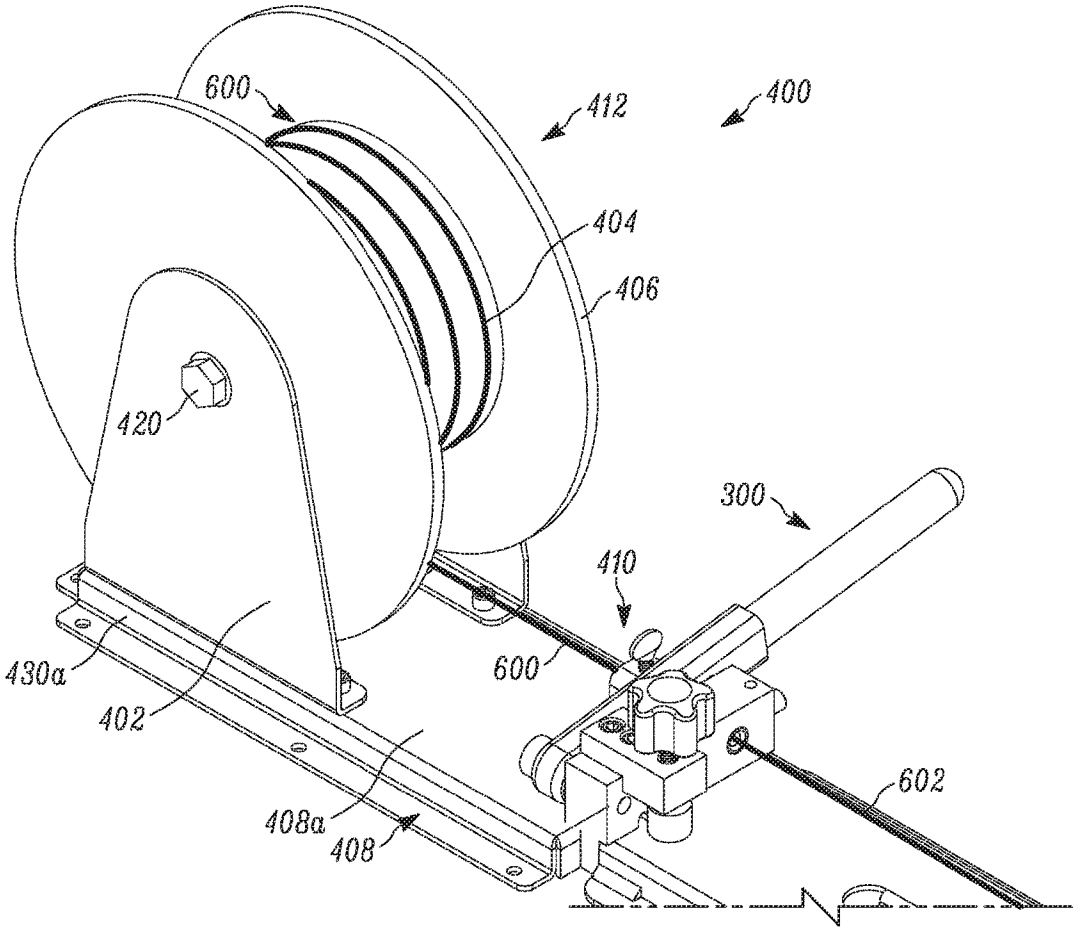
FIG. 9 is a left side perspective view of a cutting apparatus and dispensing apparatus of a gauge cutting system of FIG. 1.
Figure 10:
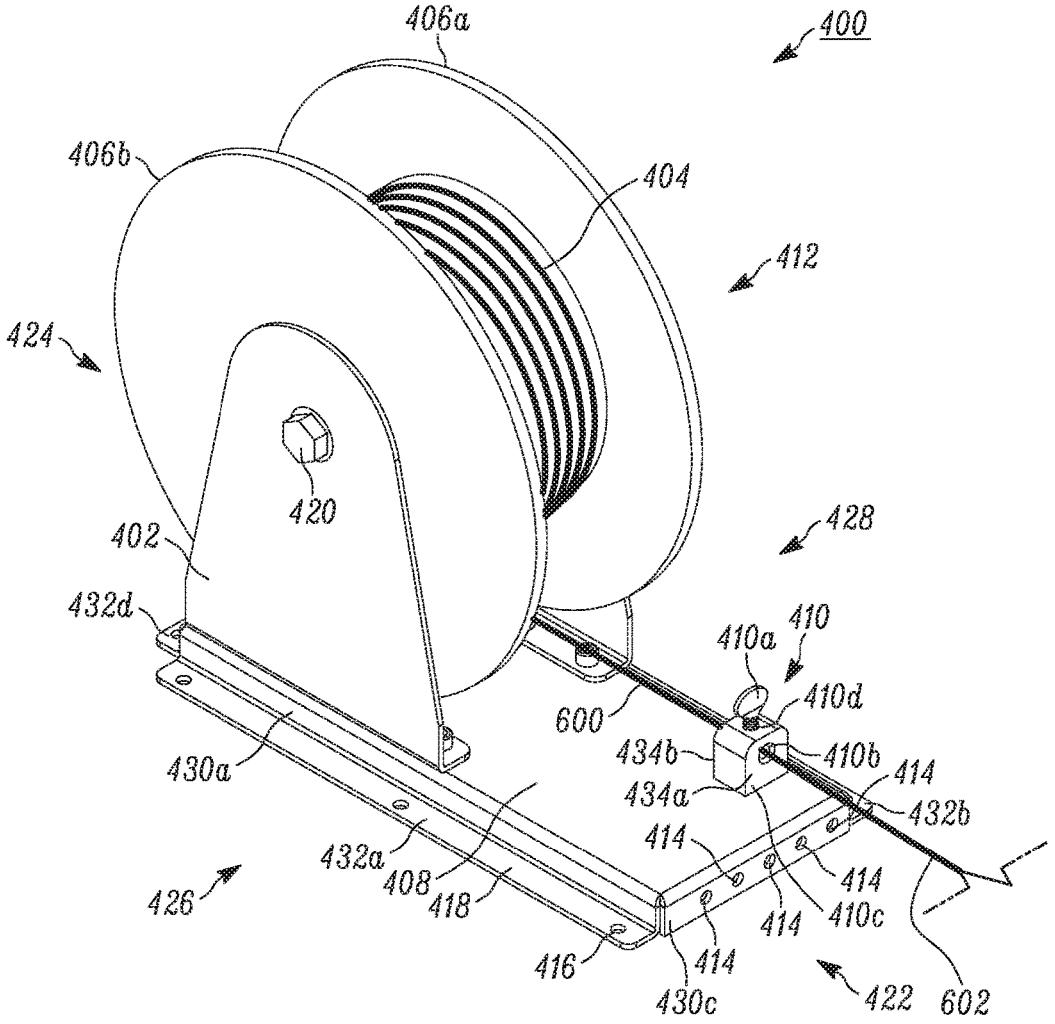
FIG. 10 is a left side perspective view of a dispensing apparatus of the gauge cutting system of FIG. 1.
Figure 11:
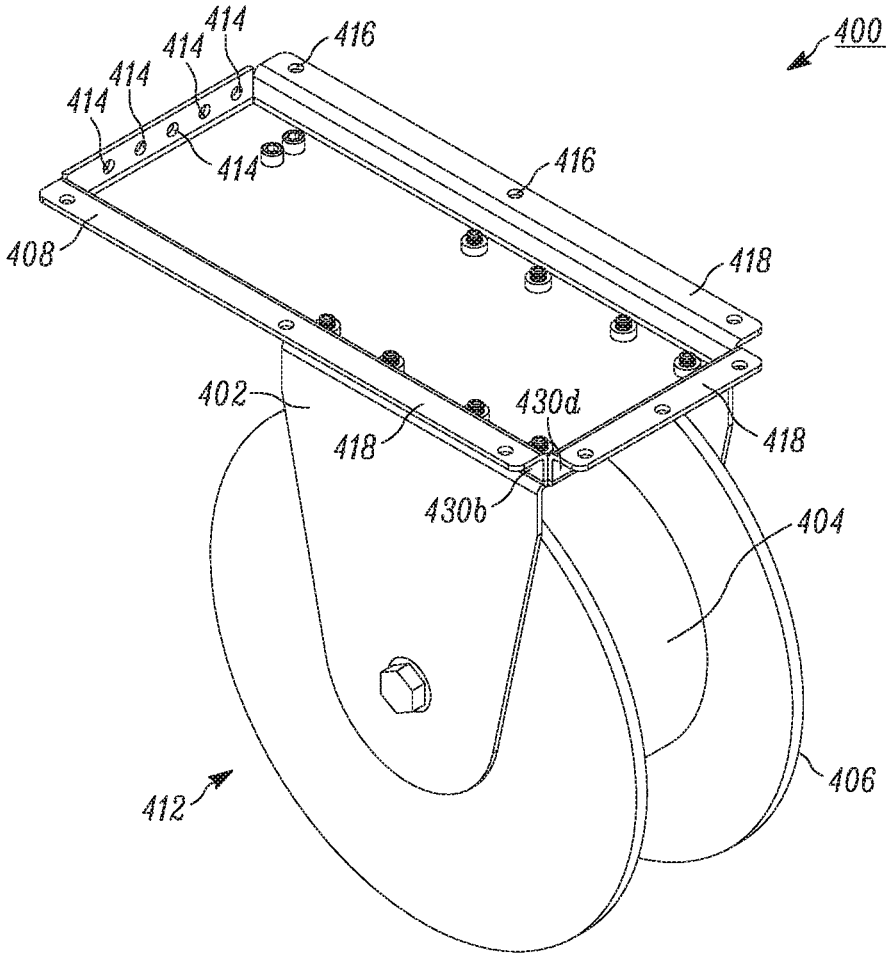
FIG. 11 is a bottom perspective view of FIG. 10.
Figure 12:
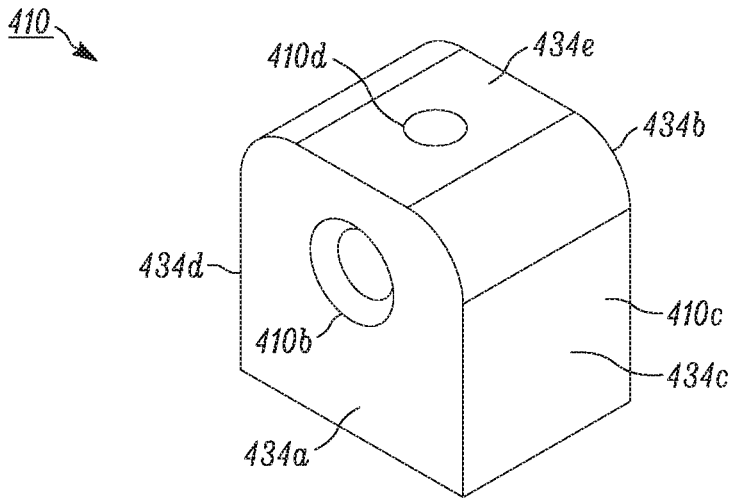
FIG. 12 is a perspective view of a securing apparatus of the dispensing apparatus of FIG. 11.

In this example embodiment, responsive to turning the head portion 504*a*, which in turn turns the connecting portion 504*b*, in a first direction, an end portion of the attachment member 504 is lowered to interact with the top portion of the base component 220 of the track 200 (see, for example, FIGS. 1-2). Stated another way, the attachment member 504 frictionally bounds the measurement apparatus 500 in place when lowered. Further in this example embodiment, responsive to turning the head portion 504*a* in a second direction opposite the first direction, the attachment member 504 is raised to stop interacting with the top portion of the base component 220 of the track 200. It would be appreciated by one having ordinary skill in the art that at least one of the hub 502, the sliding device 508, and the positioning device 506 are formed as a single body.

Figure 13:
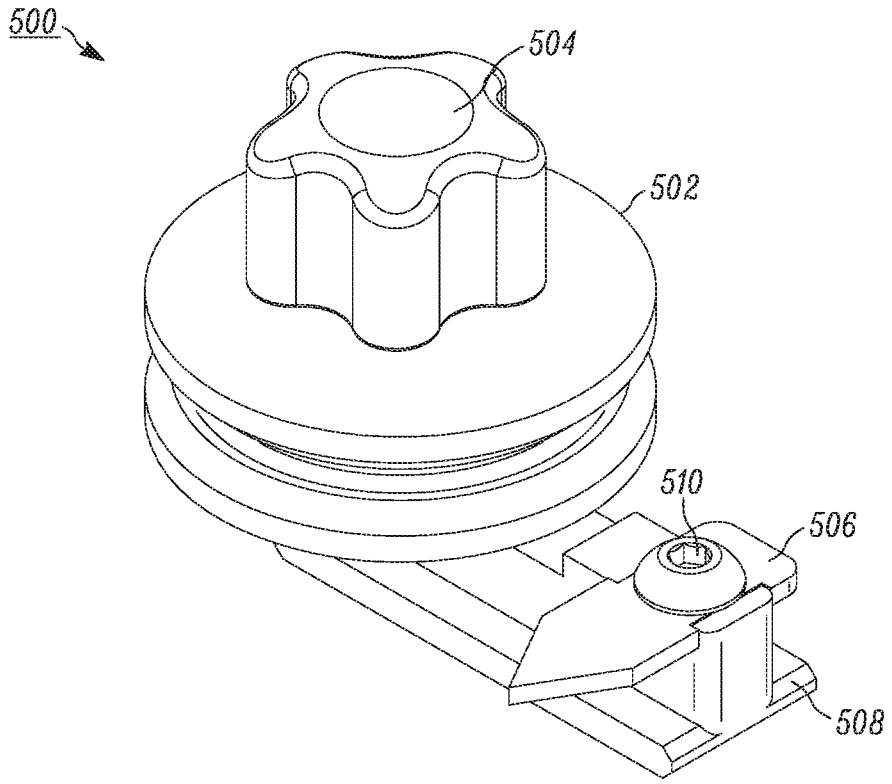
FIG. 13 is a left side perspective view of a measurement apparatus of the gauge cutting system of FIG. 1.

In an example embodiment, a user will position the measurement component 500 by sliding the component along the slot 202 until the positioning device 506 aligns with a tick mark 203 that corresponds to a desired wire length (e.g., 12 feet)(see FIG. 13). The user will rotate the head portion 504*a* in the first direction until the measurement component 500 is secured against sliding. The user will thread the spooled wire 600 through the wire opening 410*b* of the securing structure 410 and through the notch 324 (thereafter the wire comprises the wire 602 to be cut) of the blade portion 302 of the cutting apparatus 300 (see FIGS. 7, 9, and 10). The user will then loop the wire 602 around the hub 502 of the measuring apparatus 500, the wire will be positioned within the trough portion 404 (e.g., based upon the shape of the hub and the force applied by the user) (see FIG. 13). The user will bring the end of the wire 602 under the wire end securing structure 307 and into the second opening 325 (see FIG. 6). The user will rotate the head portion 318*a* in the first direction until the wire is secured between the end portion 318*b* and the top portion 224 of the track 200. If needed to keep the wire 600 taught, the user may rotate the dispensing component 412 to pull the wire taught, and then tighten the frictional tightening structure 410*a* in the wire securing structure 410 until the wire is pressed against a sidewall of the wire opening 410*b* with sufficient force to maintain the position of the wire in the wire opening 410*b* (see FIG. 10). The user will actuate the blade portion 302 of the cutting apparatus 300 to cut the wire 602 (see FIG. 9). The wire 602 will be at the length indicated by the tick marks 302 (e.g. 12 feet).

Advantageously, the wire cutting gauge 100 is attachable to a standard truck bed, van bed, or other typical automotive storage of hall space (e.g., having a length between 5' (feet) to about 6.5' (feet)). Wherein, the wire cutting gauge 100, having a length of between 5' (feet) to about 6.5' (feet) can accurately measure and cut a wire 602 to about twice the length (e.g., between about 10' (feet) to about 13' (feet)). Further, a single user can easily and quickly measure and cut the wire 602 using the wire cutting gauge 100, wherein absent the wire cutting gauge one user would hold a first end of the wire and a second user would have to measure and cut the wire, or the single user would have to lay the wire out, measure it, requiring the single user to traverse a distance equal to the length of the wire at least once, then cut it, while hoping that waviness of the wire inherent in the spooling process did not warp the measurement as the wire is not held taught.

It would be appreciated by one having ordinary skill in the art that additional tracks having additional measurement apparatuses is contemplated. For example, after looping the wire around the first measurement apparatus, the user would loop the wire around a second securing means positioned near the cutting apparatus 300 and loop the wire around the second measurement apparatus, and then secure and cut the wire in the same manner described above. Additionally, it would be appreciated that a second trough portion would be formed in the hub 502, wherein the wire 600, if required, would be looped around the second securing means and positioned within the second trough portion, before the wire is secured and cut (e.g., such as the wire length needs to be longer). The gauge cutting system 100 increases efficiency by accurately and precisely cutting wire at a desired length.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected or in contact, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A gauge cutting system comprising:

a cutting apparatus coupled to a track for cutting a wire; and a movable measurement apparatus comprising a hub, the hub for looping the wire around before returning to the cutting apparatus, the movable measurement apparatus spaced from the cutting apparatus and coupled to the track, the measurement apparatus for measuring a length of wire extending from the cutting apparatus toward the movable measurement apparatus by looping said wire around said hub and returning a cut end of the wire to the cutting apparatus, wherein a distance of the measurement apparatus from the cutting apparatus is proportional to the length of wire to be cut; and a wire end securing structure coupled to the cutting apparatus to secure the cut end of the wire after the wire is looped around the hub, wherein responsive to the wire end securing apparatus being actuated in a first manner, the wire end securing structure directly frictionally retains the cut end of the wire against the track and responsive to the wire end securing apparatus being actuated in a second manner, the first manner different than the second manner, the wire end securing structure releases the cut end of the wire.

2. The gauge cutting system of claim 1, wherein the measurement apparatus is slidably coupled to the track via a slot.

3. The gauge cutting system of claim 2, wherein the measurement apparatus comprises a sliding device slidably coupled to the slot, the sliding device comprising an elongated T shape body comprising a body portion and a cross portion.

4. The gauge cutting system of claim 3, wherein the cross portion is retained within the slot and the body portion extends above the slot.

5. The gauge cutting system of claim 1, wherein the hub comprises a wheel having a guiding groove configured to support the wire.

6. The gauge cutting system of claim 1, wherein the measurement apparatus comprises a positioning device, wherein the positioning device, responsive to the positioning device being actuated in a first manner, frictionally interacts with the track to prevent the measurement apparatus from moving along the track; and responsive to the positioning device being actuated in a second manner, the first manner different than the second manner, the positioning device stops interacting with the track allowing the measurement apparatus to move along the track.

7. The gauge cutting system of claim 1, wherein the measurement apparatus comprises a hub and an indicator, the indicator when aligned with a tick mark of a specific measurement on the track indicates a length of the wire to be cut, wherein the distance from said cutter to said hub is one half the desired length of the wire to be cut as indicated by the measurement identified by said indicator.

8. The gauge cutting system of claim 1, the cutting apparatus comprises a first through opening though which the wire extends toward the measurement apparatus from a wire supply.

9. The gauge cutting system of claim 8, the cutting apparatus comprises a blade portion comprising an exposed blade, wherein the blade is exposed within a notch, the notch being co-axial with the first through opening.

10. The gauge cutting system of claim 1, the cutting apparatus comprises a second opening which is coaxial with a wire end securing structure of the cutting apparatus, wherein a cut end of the wire is returned to the wire end securing apparatus after the wire is looped around the measurement apparatus.

11. The gauge cutting system of claim 10, wherein the wire end is inserted into the second opening, and secured into place using the wire end securing structure of the cutting apparatus.

12. A gauge cutting system comprising:

a cutting apparatus coupled to a track for cutting a wire;

a movable measurement apparatus comprising:

a hub for looping the wire around before returning to the cutting apparatus;

a sliding device slidably coupled to and partially retained within a slot of the track;

an indicator, the indicator when aligned with a tick mark of a specific measurement on the track indicates a length of the wire to be cut, wherein the distance from said cutter to said hub is one half the desired length of the wire to be cut as indicated by the measurement identified by said indicator, wherein a distance of the measurement apparatus from the cutting apparatus is proportional to the length of wire to be cut; and a wire end securing structure coupled to the cutting apparatus, the wire end securing apparatus directly frictionally retains a cut end of the wire against the track.

13. The gauge cutting system of claim 12, the cutting apparatus comprises an attachment structure defining a first through opening though which the wire is directed toward the measurement apparatus from a wire supply, wherein a blade portion of the cutting apparatus is coupled to a first side of the attachment structure, and wherein the measurement apparatus is on a second side of the attachment structure.

14. The gauge cutting system of claim 13, wherein the blade is exposed within a notch, the notch being co-axial with the first through opening.

15. The gauge cutting system of claim 12, wherein the measurement apparatus comprises a positioning device, wherein the positioning device, responsive to the positioning device being actuated in a first manner, frictionally interacts with the track to prevent the measurement apparatus from moving along the track; and responsive to the positioning device being actuated in a second manner, the first manner different than the second manner, the positioning device stops interacting with the track allowing the measurement apparatus to move along the track.

16. The gauge cutting system of claim 12, the cutting device comprising a wire end securing apparatus for securing a wire end after the wire has been looped around the hub, wherein responsive to the wire end securing structure being actuated in a first manner, the wire end securing structure frictionally retains the cut end of the wire against the track; and responsive to the wire end securing structure being actuated in a second manner, the first manner different than the second manner, the wire end securing structure releases the cute end of the wire.

17. A gauge cutting system comprising:

a cutting apparatus coupled to a track for cutting a wire, the cutting apparatus comprising:

an attachment structure defining a first through opening though which the wire is directed toward a movable measurement apparatus from a wire supply;

a blade portion of the cutting apparatus coupled to the attachment structure, the blade portion comprising a handle and a blade;

a wire end securing apparatus for directly frictionally retaining a cut end of the wire against the track, the wire end securing structure coupled to the attachment structure; and the measurement apparatus slidably coupled to the track via a slot, the measurement apparatus comprising:

a hub for looping the wire around before returning to the cutting apparatus;

a sliding device slidably coupled to and partially retained within the slot of the track; and an indicator, the indicator when aligned with a tick mark of a specific measurement on the track indicates a length of the wire to be cut, wherein the distance from said cutter to said hub is one half the desired length of the wire to be cut as indicated by the measurement identified by said indicator, wherein a distance of the measurement apparatus from the cutting apparatus is proportional to the length of wire to be cut.

18. The gauge cutting system of claim 17, wherein responsive to the wire end securing structure being actuated in a first manner, the wire end securing structure frictionally retains the cut end of the wire against the track; and responsive to the wire end securing structure being actuated in a second manner, the first manner different than the second manner, the wire end securing structure releases the cute end of the wire.

19. The gauge cutting system of claim 17, wherein the cutting apparatus is between a wire supply that supplies the wire and the measurement apparatus, wherein a blade portion of the cutting apparatus is coupled to a first side of the attachment structure nearer to the wire supply, and wherein the measurement apparatus is on a second side of the attachment structure, the first side comprising a side opposite the first side.

* * * * *